United States Patent [19]

Thomlinson et al.

[11] Patent Number: 4,938,690

[45] Date of Patent: Jul. 3, 1990

[54] INGOT PUSHER FURNACE WITH RAIL DRAWBRIDGES

[75] Inventors: Gordon Thomlinson; Barry Dudek, both of Meadville, Pa.

[73] Assignee: Seco/Warwick Corporation, Meadville, Pa.

[21] Appl. No.: 364,835

[22] Filed: Jun. 12, 1989

[51] Int. Cl.[5] ..... F27D 3/00; F27D 1/12

[52] U.S. Cl. ..... 432/239; 432/250; 432/242; 432/243; 432/244; 110/173 R

[58] Field of Search ..... 432/242–244, 432/250, 239, 237; 110/180, 173 R, 173 B

[56] References Cited

U.S. PATENT DOCUMENTS

| | | | |
|---|---|---|---|
| 2,033,331 | 3/1936 | DeCinolis et al. | 432/237 |
| 2,254,900 | 9/1941 | Lessmann | 432/250 |
| 2,270,484 | 1/1942 | Wallerius | 432/250 |
| 4,054,411 | 10/1977 | Beck | 110/173 R |
| 4,427,378 | 1/1984 | Bowers | 432/250 |
| 4,859,178 | 8/1989 | Ross | 432/250 |

*Primary Examiner*—Henry C. Yuen
*Attorney, Agent, or Firm*—Davis Chin

[57] ABSTRACT

An ingot pusher furnace includes means for reducing heat loss from the charging and discharging ends of the furnace so as to produce a more efficient and uniform heating of the ingots. The pusher furnace includes support rails which extend between a first opening in the front wall and a second opening in the rear wall and terminates inside of the charging and discharging doors. The charging and discharging doors extend below the support rails in their closed position so as to provide a positive seal. A first rail drawbridge is arranged adjacent the charging door to facilitate movement of the ingots into the furnace enclosure. The second rail drawbridge is arranged adjacent the discharging door to facilitate movement of the ingots out of the furnace enclosure.

14 Claims, 5 Drawing Sheets

INGOT PUSHER FURNACE WITH RAIL DRAWBRIDGES

This application is a continuation-in-part of copending application Ser. No. 232,271 filed Aug. 15, 1988, and entitled "Ingot Pusher Furnace With Means for Reducing Heat Loss."

BACKGROUND OF THE INVENTION

This invention relates generally to ingot pusher furnaces and more particularly, it relates to an improved pusher furnace which includes means for reducing heat loss from the charging and discharging ends of the furnace so as to produce a more efficient and uniform heating of the ingots.

A prior art furnace 10 is illustrated in FIG. 1 of the drawings and has been labeled "Prior Art." As can be seen, the rails 36 used for support and movement of a plurality of aluminum ingots 38 to be heated into and out of the enclosure 20 actually extend beyond charging end 17 and discharging end 19 of the furnace 10. As a result, there is created a difficult problem in obtaining an efficient sealing of the furnace. The bottoms of the charging door 24 and discharging door 28 in their closed positions will come to rest on the top surface of the rails 36. Thus, there is a great likelihood of outside cold air to leak into the furnace around the rails at the locations where they extend through the respective door openings.

Such influx of cold air has a tendency to upset the temperature uniformity by causing a cold spot or "chill" to be formed on the next ingot to be discharged, which means that the quality of the finished rolled aluminum has been sacrificed. Further, heat loss from the furnace due to the leaks will mean the wasting of energy, thereby reducing its overall efficiency.

It would therefore be desirable to provide an improved ingot pusher furnace which includes means for reducing heat loss from the charging and discharging ends of the furnace so as to produce a more efficient and uniform heating of the ingots. This is accomplished in the present invention by the provision of support rails that terminate inside of the charging and discharging doors and by fabricating the doors to extend below the support rails, thereby creating a positive seal on each side of the doors.

SUMMARY OF THE INVENTION

Accordingly, it is a general object of the present invention to provide an improved ingot pusher furnace which is relatively simple and economical to manufacture and assemble, but yet overcomes the disadvantages of the prior art furnaces.

It is an object of the present invention to provide an ingot pusher furnace which includes means for reducing heat loss from the charging and discharging ends thereof.

It is another object of the present invention to provide an ingot pusher furnace which includes support rails extending between a first opening in the front wall and a second opening in the rear wall and terminating inside of the charging and discharging doors, the charging and discharging doors extending below the support rails in their closed position so as to provide a positive seal.

It is still another object of the present invention to provide an ingot pusher furnace which includes means cooperating with support rails terminating inside of the charging and discharging doors for facilitating loading and unloading of ingots into and out of the furnace enclosure.

It is still another object of the present invention to provide an ingot pusher furnace which includes a first rail drawbridge arranged adjacent the charging door to facilitate movement of ingots into the furnace enclosure and a second rail bridge arranged adjacent to the discharging door to facilitate movement of ingots out of the furnace enclosure.

In accordance with these aims and objectives, the present invention is concerned with the provision of an improved ingot pusher furnace which includes an insulated furnace enclosure formed by a bottom wall, a front wall, a rear wall and a top wall. The enclosure receives a plurality of ingots to be heated. A plurality of heat sources are provided to heat a gaseous medium within the enclosure. A plurality of fans are provided to circulate the gaseous medium within the enclosure. Support rails are disposed in the bottom wall for facilitating support and movement of the ingots within the enclosure. A charging door located adjacent the front wall is adapted to close a first opening formed in the front wall. A discharging door located adjacent the rear wall is adapted to close a second opening formed in the rear wall. The support rails extend between the first opening in the front wall and the second opening in the rear wall and terminates inside of the charging and discharging doors. The charging and discharging doors extend below the support rails in their closed positions so as to provide a positive seal.

BRIEF DESCRIPTION OF THE DRAWINGS

These and other objects and advantages of the present invention will become more fully apparent from the following detailed description when read in conjunction with the accompanying drawings with like reference numeral indicating corresponding parts throughout, wherein:

FIG. 2(*b*) is a side elevational view of an ingot pusher furnace of the present invention with an up-ender mechanism illustrating the charging door in the closed position;

FIG. 3(*b*) is a side elevational view of an ingot pusher furnace of the present invention with a down-ender mechanism, illustrating the discharging door in the closed position;

DESCRIPTION OF THE PREFERRED EMBODIMENT

Figure 1:
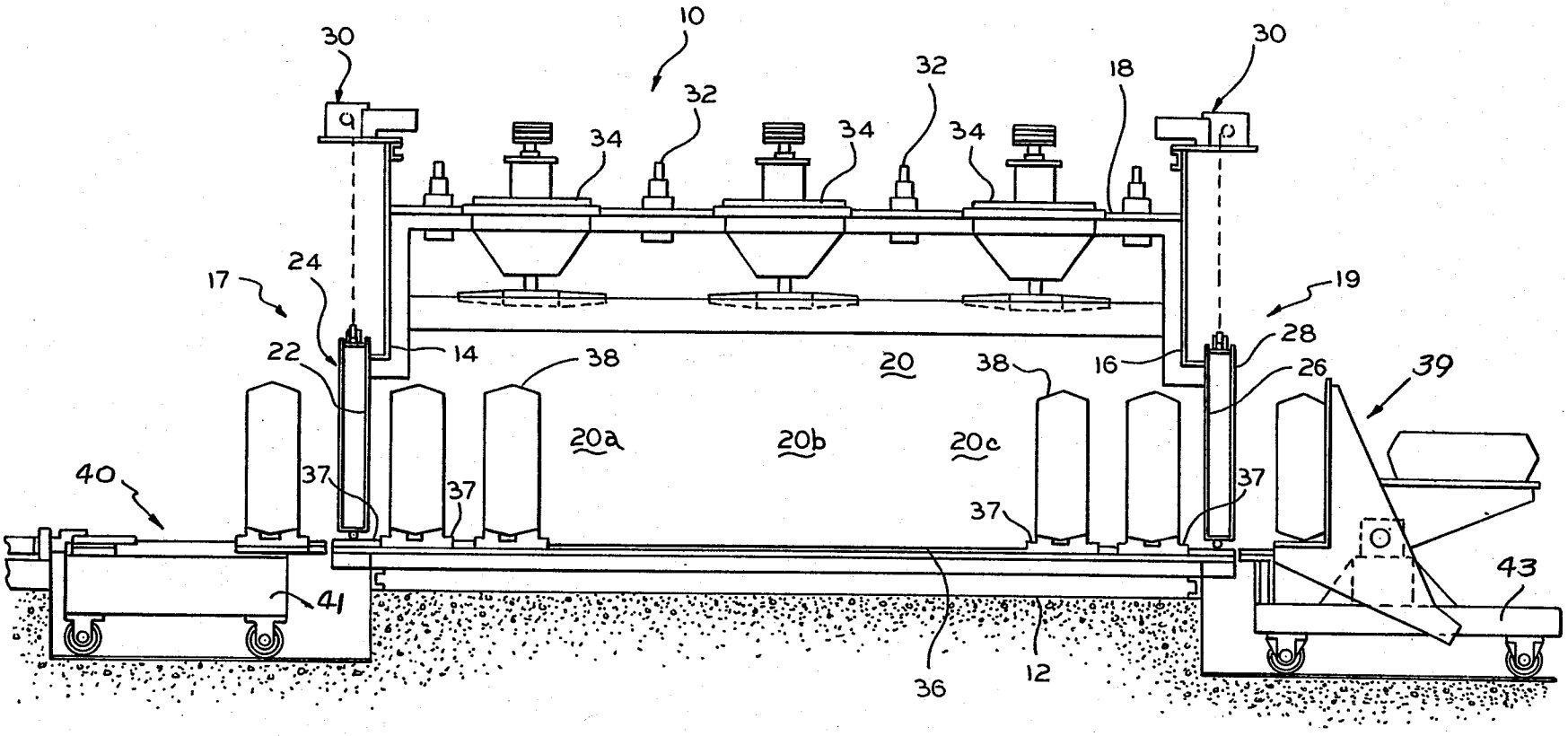
FIG. 1 (PRIOR ART)
FIG. 1 is a side elevational view of an ingot pusher furnace of the prior art.

Referring now in detail to the drawings, there is illustrated in FIG. 1 an ingot pusher furnace of the prior art designated generally by reference numeral 10. The pusher furnace 10 includes a bottom wall 12, a front wall 14, a rear wall 16, and a top wall or roof 18 which are used to define an insulated enclosure 20. The front wall 14 is formed with a large entrance opening 22 which is covered by a front charging door 24. The rear wall 16 is formed with a large exit opening 26 which is covered by a rear discharging door 28. The front charging and rear discharging doors 26, 28 are adapted to slide in a vertical plane under the control of elevating mechanisms 30 which are well known in the art.

A plurality of conventional gas burners 32 are positioned in the top wall 18 and deliver a hot gaseous medium to the insulated enclosure 20. In alternate embodiments of the pusher furnace, radiant tube gas fired or electric heaters may be utilized to heat the enclosure 20. The insulated enclosure 20 is divided into a plurality of heating zones 20*a*, 20*b* and 20*c*. The top wall 18 supports a plurality of large gas recirculating fan assembles 34 which are used to move the hot gaseous medium within the heating zones of the enclosure. In the bottom wall 12, there are formed a plurality of support rails, one of which is depicted and designated by reference numeral 36, which facilitate the support and movement of a plurality of aluminum ingots 38 to be heated within the enclosure 20. The aluminum ingots 38 are substantially rectangular in shape and the underneath surfaces thereof are supported by respective shoe assemblies 37. The shoe assemblies are supported by the rails 36.

As can be seen from FIG. 1, the support rails 36 actually extend a predetermined distance beyond both the entrance opening 22 at the charging end 17 and the exit opening 26 at the discharging end 19 of the furnace 10. Thus, in the closed position the bottom of the charging door 24 will come to rest upon the top surface of the support rails 36. Similarly, in the closed position the bottom of the discharging door 28 will come to rest upon the top surface of the support rails 36. As a result, outside cold air is very likely to leak into the furnace enclosure 20 around the rails 36 at the location where they extend through the respective door openings 22, 26. Further, the hot gaseous medium within the enclosure 20 will be lost due to the leaks causing wasting of energy and thus redoing the efficiency of the furnace.

In FIG. 1, there is shown one type of handling mechanism 40 referred to generally as an "up-ender" mechanism which is positioned at the charging end 17 of the furnace. The up-ender mechanism 40 may be located on an ingot transfer car or cart 41 and is used to push forward the ingots 38 to be heated into the furnace at the charging end thereof via the entrance opening 22. Further, another type of handling mechanism 39 such an ingot rotating mechanism referred generally to as a down-ender mechanism is positioned at the discharging end 19 of the furnace. The down-ender mechanism may also be located on an ingot transfer car or cart 43 and is used to carry the ingots 38 after heating away from the furnace via the exit opening 26.

Figure 2B:
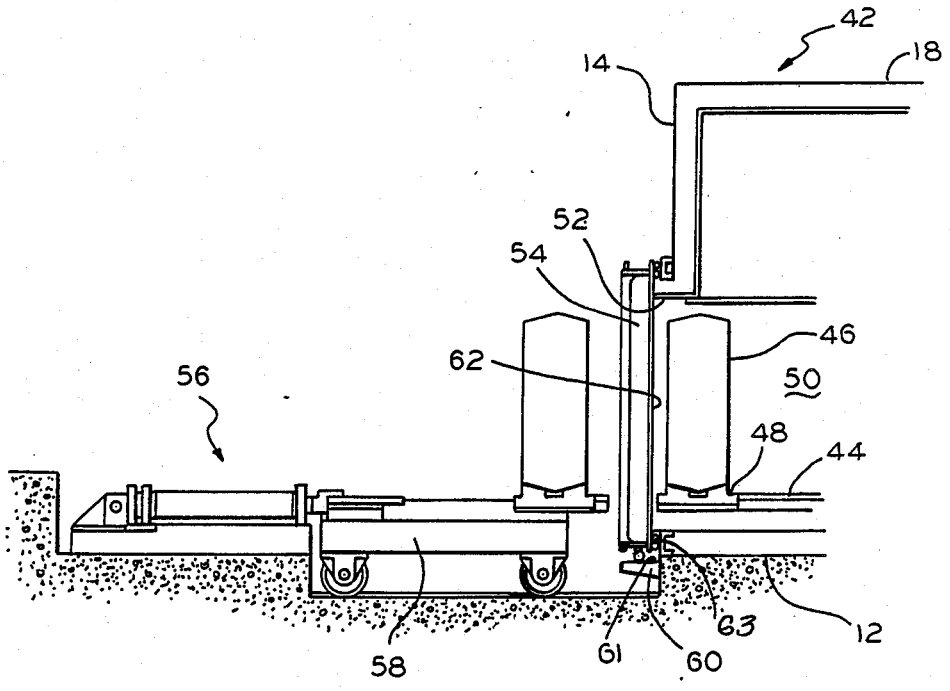
FIG. 2(*a*) is a side elevational view of an ingot pusher furnace of the present invention with an up-ender mechanism illustrating the charging door in the open position.
Figure 2A:
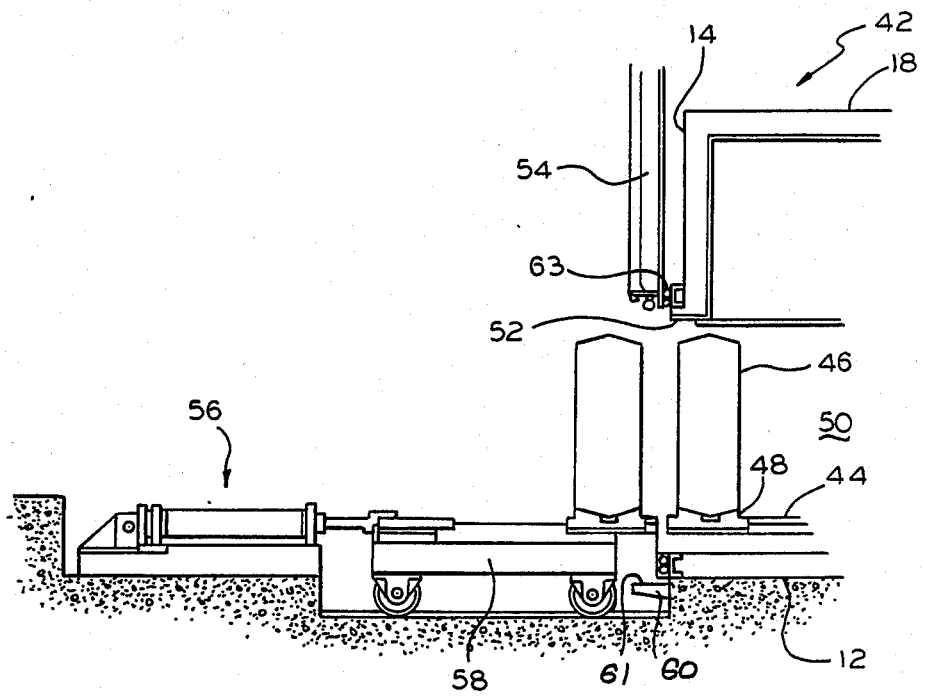

The present invention is an improvement over the ingot pusher furnace 10 of FIG. 1 and includes means for creating effective seals at he charging and discharging ends of the furnace so as to produce a more uniform heating of the ingots. In FIG. 2(*a*), there is shown a charging end portion of an improved ingot pusher furnace 42 of the present invention. The pusher furnace 42 includes support rails, one of which is depicted and designated by reference numeral 44, for facilitating the support and movement of the ingots 46 to be heated through its insulated enclosure 50. The rails 44 carry shoe assemblies 48 which are used to support the underneath surfaces of the aluminum ingots 46.

The support rails 44 are designed so as to terminate or end substantially at the entrance door opening 52 and do not extend beyond the door opening 52. With charging door 54 in its open position, an up-ender mechanism 56 similar to the handling mechanism 40 of FIG. 1 is used to push forward the ingot 46 and shoe assembly 48 into the furnace enclosure 50 and all of the ingots already within the furnace each are advanced a step forward. After the ingot has been pushed forward, the car or cart 58 carrying the up-ender mechanism 56 is moved back to a position shown in FIG. 2(*b*) and the charging door 54 is lowered by a suitable mechanism so as to assume a closed position. As will be noted in FIG. 2(*b*), the charging door 54 extends below the support rail 44 and comes to rest on a stop member 60. As a result, the ends of the rails terminate inside of the charging door 54 and are substantially flush with the interior surface 62 of the charging door thereby creating a positive seal at the lower end of the door.

The stop member 60 is disposed adjacent the front wall 14 and below the support rails 44. The stop member 60 is preferably of a triangular-shaped configuration and has a top surface 61. The bottom surface of the charging door 54 may be provided with a sealing member 63 for contacting the top surface of the stop member 60 when the charging door is in the closed position.

Figure 3A:
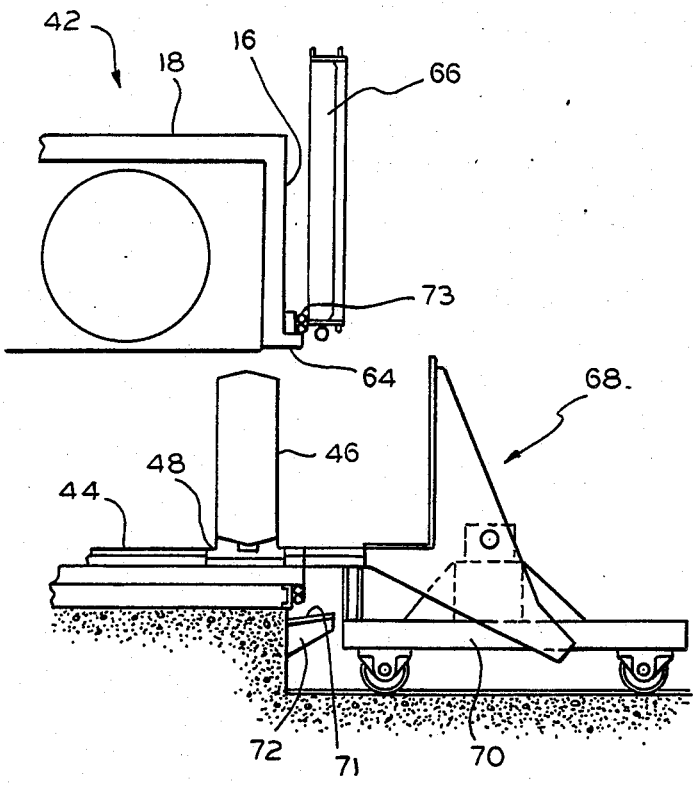
FIG. 3(i a) is a side elevational view of an ingot pusher furnace of the present invention with a down-ender mechanism, illustrating the discharging door in the open position.
Figure 3B:
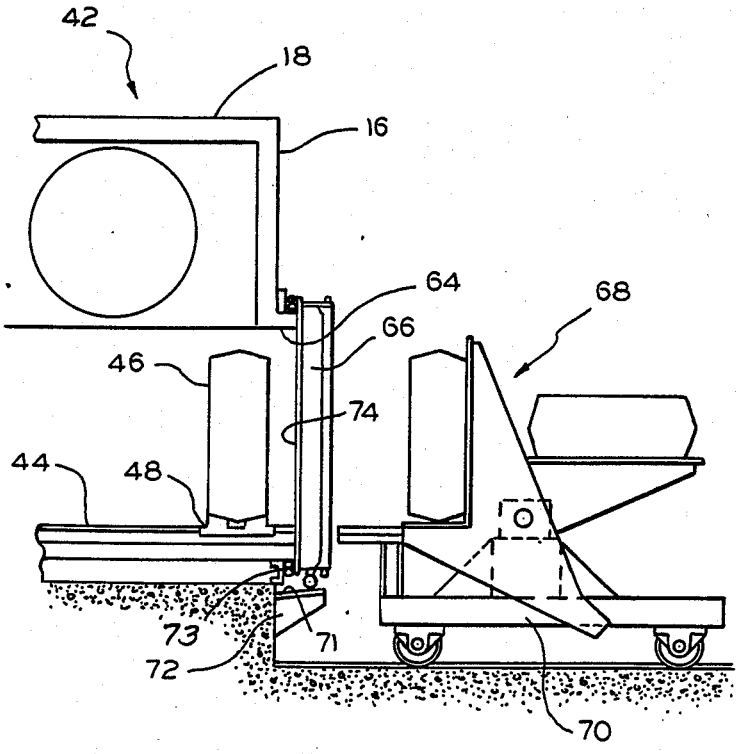

In FIG. 3(*a*) of the drawings, there is shown a discharging end portion of the improved ingot pusher furnace 42 of the present invention. Similarly, the support rails 44 terminate or end substantially at the exit door opening 64 and do not extend beyond the door opening 64. With discharging door 66 in its open position, a down-ender or ingot rotating mechanism 68 similar to the handling mechanism 39 of FIG. 1 is used to receive the heated ingots as they are discharged from the furnace. Then, the car or cart 70 carrying the down-ender mechanism 68 is moved away from the furnace to a position shown in FIG. 3(*b*) and the discharging door 66 is lowered by a suitable mechanism so as to assume a closed position. As can be seen in FIG. 3(*b*), the discharging door 66 extends below the rails 44 and the bottom thereof comes to rest on a stop member 72. Consequently, the ends of the, rails 44 terminate inside of the discharging door 66 and are substantially flush with the interior surface 74 of the discharging door, providing a positive seal at the lower end of the door.

The stop member 72 is disposed adjacent the rear wall 16 and below the support rails 44. The stop member 72 is preferably of a triangular-shaped configuration and has a top surface 71. The bottom surface of the discharging door 66 may be provided with a sealing member 73 for contacting the top surface of the stop member 72 when the discharging door 66 is in the closed position.

Figure 4:
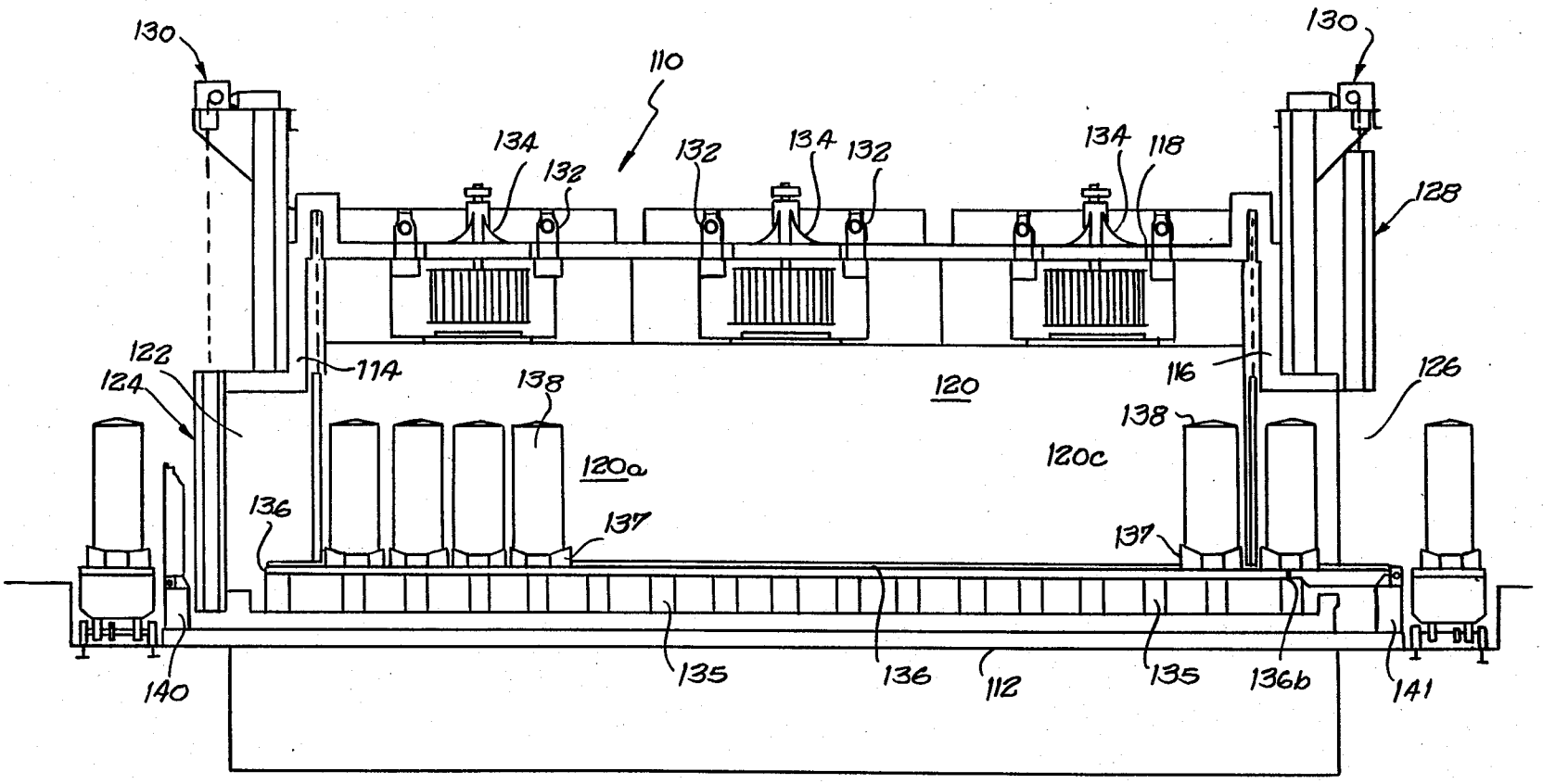
FIG. 4 is a side elevational view of another embodiment of the ingot pusher furnace according to the present invention and having rail drawbridges arranged adjacent the charging and discharging doors.

Another embodiment of the present invention is illustrated in FIG. 4, wherein an improved ingot pusher furnace 110 is shown therein. The ingot pusher furnace 110 includes a bottom wall 112, a front wall 114, a rear wall 116, and a top wall or roof 118 which are used to define an insulated enclosure 120. The top wall 118 is formed with a large entrance opening 122 which is covered by a front charging door 124. The rear wall 116 is formed with a large exit opening 126 which is covered by a rear discharging door 128. The front charging and rear charging doors 126, 128 are adapted to slide in a vertical plane under the control of elevating mechanisms 130 which are well known in the art.

A plurality of gas burners 132 are positioned in the top wall 118 and deliver a hot gaseous medium to the insulated enclosure 120. Radiant tube gas fired or electric heaters may be utilized alternately to heat the enclosure 120 in lieu of the gas burners. The insulated enclosure 120 is divided into a plurality of heating zones **120*a*, 120*b* and 120*c*. The top wall 118 supports a plurality of barge gas recirculating fan assemblies 134 which are used to move the hot gaseous medium within the heating zones of the enclosure. A plurality of support rails, one of which is depicted and designated by reference numeral 136, are supported above the bottom wall 112 by a plurality of posts 135. The support rails serve to facilitate the support and movement of a plurality of aluminum ingots 138 to be heated within the enclosure 120. The aluminum ingots 138 are substantially rectangular in shape and the underneath surfaces thereof are supported by respective shoe assemblies 137. Shoe assemblies are supported on their underlying surfaces by the support rails 136**.

As can be seen from FIG. 4, the ends **136*a*, 136*b* of support rails 136 are designed so as to terminate inside of the respective charging and discharging doors 124, 126, and the doors are fabricated to extend below the support rails when closed, thereby creating a positive seal on each side of the doors. It will be noted that in FIG. 2**(*a*) the car 58 is required to be moved initially to the right so as to close the gap and mate with the ends of the support rails before the ingot can be pushed forward into the furnace enclosure 50. Further, after the ingot has been pushed forward, the car 58 must be moved back to the position shown in FIG. 2(*b*) so that charging door 54 can be closed to provide an efficient seal. It will also be noted that similar operations are required for the car 70 shown in FIGS. 3(*a*) and 3(*b*) so as to receive the ingots as they are discharged before the discharging door 66 can be closed.

It should be apparent that the requirements for efficient furnace door seals are not always compatible with the needs for easy access to the furnace enclosure for loading and unloading of the ingots. In order to address this problem, the improved ingot pusher furnace 110 has been provided with means disposed adjacent the charging and discharging doors and cooperating with the ends of the support rails so as to facilitate the loading and unloading of the ingots. This means is comprised of a first rail drawbridge mechanism 140 located adjacent the charging door to facilitate the movement of the ingots into the furnace enclosure and a second rail drawbridge mechanism 141 located adjacent the discharging door to facilitate movement of the ingots out of the furnace enclosure.

Figure 5:
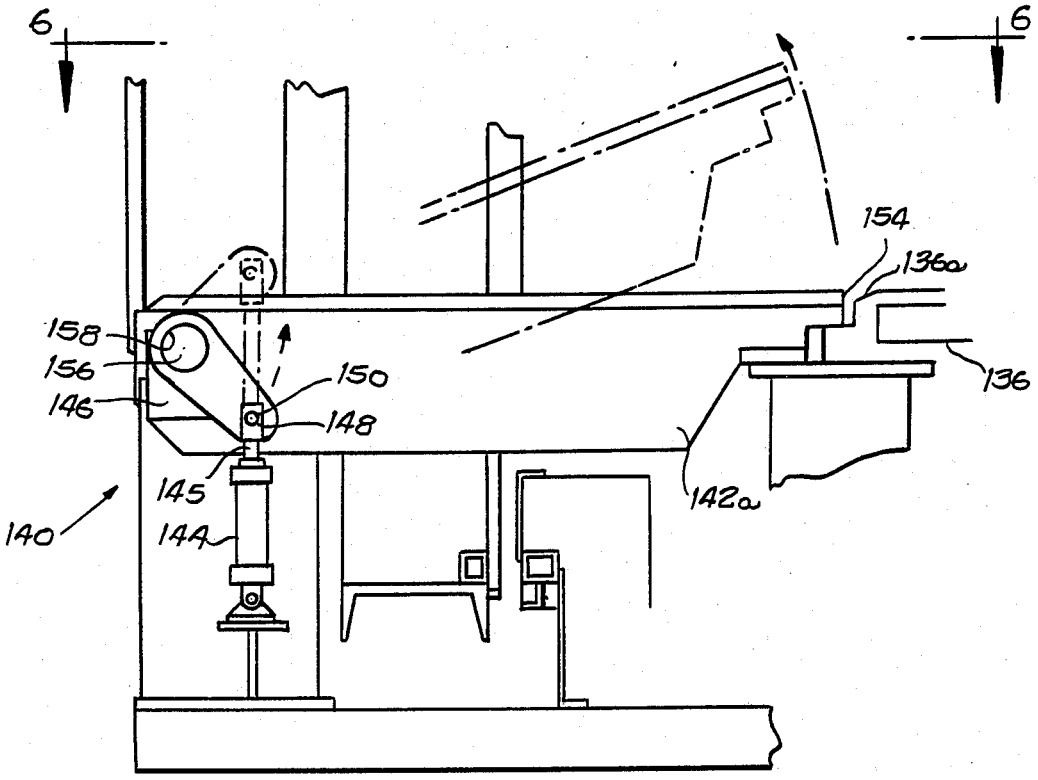
FIG. 5 is an enlarged view of the rail drawbridge of FIG. 4 arranged adjacent the charging door, illustrating the drawbridge in the lowered position.
Figure 6:
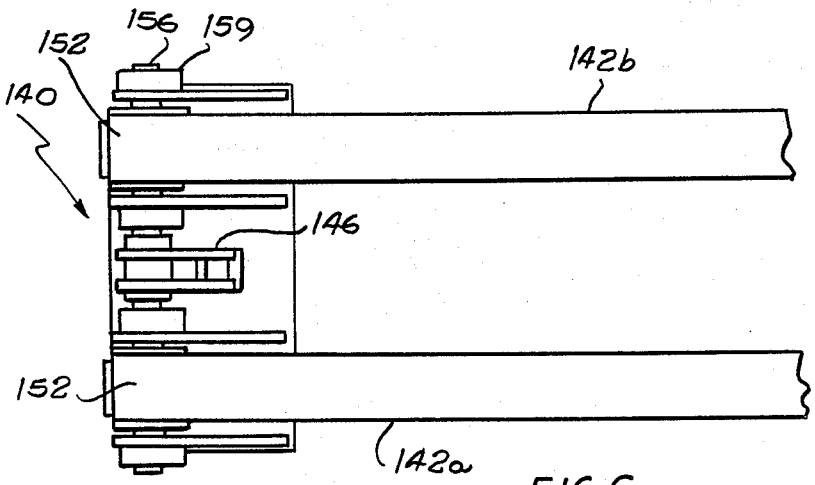
FIG. 6 is a top plan view of the rail drawbridge, taken along the lines 6—6 of FIG. 5

The rail drawbridge mechanism 140 includes a pair of rail members or platforms **142*a*, 142*b*, illustrated in FIG. 6, which are movable between a raised vertical position (FIG. 4) so that the charging door 122 can be closed and a lowered horizontal position (FIG. 5) to permit loading of the ingots into the furnace enclosure. The rail drawbridge mechanism 141 is identical in construction to the mechanism 140 and includes a pair of rail members which are movable between a raised vertical position so that the discharging door 126 can be closed and a lowered horizontal position (FIG. 4**) to permit unloading of the ingots out of the furnace enclosure.

As can best be seen from FIGS. 5 and 6, each of the rail members **142*a*, 142*b* is raised and lowered by actuator means formed of a hydraulic or pneumatic cylinder 144 having a piston rod 145 movable therein. The outer end of the piston rod 145 is secured to one end of a pair of rocker members 146 by means of a clevis pin 148 received in a hole 150. The other ends of the rocker members 146 are pivotally connected to ends 152 of the respective rail members 142*a* and 142*b* by means of a clevis pin 156 received in a hole 158 which is formed in a linkage member 159**.

In the lowered horizontal position, the charging door 124 is opened and the inner ends 154 of the rail members **142*a* and 142*b* contactly engage the ends 136*a* of the support rails 136. When the piston rod 145 is moved upwardly from the cylinder 144, the rail members 142*a* and 142*b* are rotated approximately 90° in a counterclockwise manner to the raised vertical position, as shown in the dotted lines of FIG. 5. As a result, the charging door 124** can now be closed to effect the positive seal.

In order to lower the rail members **142*a*, 142*b*, the charging door 124 must be opened and then the piston rod 145 is retracted into the cylinders 144. This causes the rail members to be rotated approximately 90° in the clockwise direction to be lowered to the horizontal position, as shown in the solid lines of FIG. 5**.

From the foregoing detailed description, it can thus be seen that the present invention provides an improved ingot pusher furnace which includes means for reducing heat loss from the charging and discharging ends of the furnace so as to produce a more efficient and uniform heating of the ingots. The pusher furnace of the present invention includes support rails extending between a first opening in the front wall and a second opening in the rear wall and terminating inside of the charging and discharging doors. Further, the charging and discharging doors extend below the support rails in their closed position so as to provide a positive seal.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An ingot pusher furnace comprising:

an insulated furnace enclosure including a bottom wall, a front wall, a rear wall and a top wall, said enclosure receiving a plurality of ingots to be heated;

means for heating said enclosure by heating a gaseous medium therein:

means for moving said gaseous medium within said enclosure;

support rails being disposed in association with said bottom wall for facilitating support and movement of the ingots within said enclosure;

a charging door located adjacent said front wall and being adapted to close a first opening formed in said front wall;

a discharging door located adjacent said rear wall and being adapted to close a second opening formed in said rear wall;

said support rails extending between said first opening in said front wall and said second opening in said rear wall and terminating inside of said charging and discharging doors;

said charging and discharging doors extending below said support rails in their closed position so as to provide a positive seal;

first rail bridge means cooperating with said support rails terminating inside of said charging door for facilitating movement of the ingots into said enclosure;

said first rail bridge means including at least one rail member which is movable between a raised vertical position so that the charging door can be moved to the closed position and a lowered horizontal position to permit loading of the ingots into said enclosure;

second rail bridge means cooperating with said support rails terminating inside of said discharging door for facilitating movement of the ingots out of said enclosure; and said second rail bridge means including at least one rail member which is movable between a raised vertical position so that said discharging door can be moved to the closed position and a lowered horizontal position to permit unloading of the ingots out of said enclosure.

2. An ingot pusher furnace as claimed in claim 1, wherein said first rail bridge means includes a first pair of rail members whose ends contactly engage outer ends of said support rails in the lowered horizontal position.

3. An ingot pusher furnace as claimed in claim 2, wherein the other ends of said first pair of rail members are pivotally connected to one end of first rocker members.

4. An ingot pusher furnace as claimed in claim 3, further comprising first actuating means operatively connected to the other end of said first rocker member for raising and lowering of said first pair of rail members.

5. An ingot pusher furnace as claimed in claim 4, wherein said first actuating means comprises a hydraulic or pneumatic cylinder and a piston rod.

6. An ingot pusher furnace as claimed in claim 5, wherein said second rail bridge means includes a second pair of rail members whose ends contactly engage outer ends of said support rails in the lowered horizontal position.

7. An ingot pusher furnace as claimed in claim 6, wherein the other ends of said second pair of rail members are pivotally connected to one end of second rocker members.

8. An ingot pusher furnace as claimed in claim 7, further comprising second actuating means operatively connected to the other end of said second rocker member for raising and lowering of said second pair of rail members.

9. An ingot pusher furnace as claimed in claim 8, wherein said second actuating means comprises a hydraulic or pneumatic cylinder and a piston rod.

10. An ingot pusher furnace comprising:

an insulated furnace enclosure including a bottom wall, a front wall, a rear wall and a top wall, said enclosure receiving a plurality of ingots to be heated;

means for heating said enclosure by heating a gaseous medium therein;

means for moving said gaseous medium within said enclosure;

support rails being disposed in association with said bottom wall for facilitating support and movement of the ingots within said enclosure;

a charging door located adjacent said front wall and being adapted to close an opening formed in said front wall;

said support rails extending between said front wall and said rear wall and terminating inside of said charging door;

said charging door extending below said support rails in its closed position so as to provide a positive seal;

rail bridge means cooperating with said support rails terminating inside of said charging door for facilitating movement of the ingots into said enclosure; and said rail bridge means including at least one rail member which is movable between a raised vertical position so that the charging door can be moved to the closed position and a lowered horizontal position to permit loading of the ingots into said enclosure.

11. An ingot pusher furnace as claimed in claim 10, wherein said rail bridge means includes a pair of rail members whose ends contactly engage outer ends of said support rails in the lowered horizontal position.

12. An ingot pusher furnace as claimed in claim 11, wherein the other ends of said first pair of members are pivotally connected to one end of rocker members.

13. An ingot pusher furnace as claimed in claim 12, further comprising actuating means operatively connected to the other end of said rocker member for raising and lowering of said pair of rail members.

14. An ingot pusher furnace as claimed in claim 13, wherein said actuating means comprises a hydraulic or pneumatic cylinder and a piston rod.

* * * * *